US009356348B2

(12) United States Patent
Chen

(10) Patent No.: US 9,356,348 B2
(45) Date of Patent: May 31, 2016

(54) ANTENNA STRUCTURE

(71) Applicant: Chi Mei Communication Systems, Inc., New Taipei (TW)

(72) Inventor: Hsi-Chieh Chen, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 329 days.

(21) Appl. No.: 13/947,645

(22) Filed: Jul. 22, 2013

(65) Prior Publication Data

US 2014/0085145 A1 Mar. 27, 2014

(30) Foreign Application Priority Data

Sep. 25, 2012 (TW) ..... 101135033 A

(51) Int. Cl.

| | |
|---|---|
| ***H01Q 1/38*** | (2006.01) |
| ***H01Q 5/00*** | (2015.01) |
| ***H01Q 1/24*** | (2006.01) |
| ***H01Q 9/42*** | (2006.01) |
| ***H01Q 5/371*** | (2015.01) |
| ***H01Q 5/378*** | (2015.01) |

(52) U.S. Cl.

CPC ..... *H01Q 5/0027* (2013.01); *H01Q 1/243* (2013.01); *H01Q 5/371* (2015.01); *H01Q 5/378* (2015.01); *H01Q 9/42* (2013.01)

(58) Field of Classification Search

CPC ..... H01Q 1/24
USPC ..... 343/700 MS, 702, 750, 846
See application file for complete search history.

(56) References Cited

U.S. PATENT DOCUMENTS

| | | | | |
|---|---|---|---|---|
| 7,602,343 | B2 * | 10/2009 | Takada | H01Q 1/243 343/700 MS |
| 7,911,387 | B2 * | 3/2011 | Hill | H01Q 1/243 343/700 MS |
| 2007/0030204 | A1 * | 2/2007 | Heng | H01Q 1/22 343/702 |
| 2008/0316116 | A1 * | 12/2008 | Hobson | H01Q 1/243 343/702 |
| 2009/0273531 | A1 * | 11/2009 | Ishizuka | H01Q 1/243 343/750 |

* cited by examiner

*Primary Examiner* — Huedung Mancuso
(74) *Attorney, Agent, or Firm* — Novak Druce Connolly Bove + Quigg LLP

(57) ABSTRACT

An antenna structure includes a feed end, a grounding end, at least one main radiator, and at least one coupling radiator. The grounding end is separated from the feed end. The at least one main radiator is connected to the feed end. The at least one coupling radiator is connected to the grounding end. Current on the feed end is coupled to the grounding end, and current on the least one main radiator is coupled to the at least one coupling radiator.

15 Claims, 2 Drawing Sheets

ANTENNA STRUCTURE

BACKGROUND

1. Technical Field

The present disclosure relates to an antenna structure for a wireless communication device.

2. Description of Related Art

Antennas are found in many wireless communication devices such as mobile phones for example. A wireless communication device may receive/transmit wireless signals having different frequencies, requiring the presence of a multiband antenna. However, many multiband antennas have complicated structures and are large in size, making it difficult to miniaturize wireless electronic devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
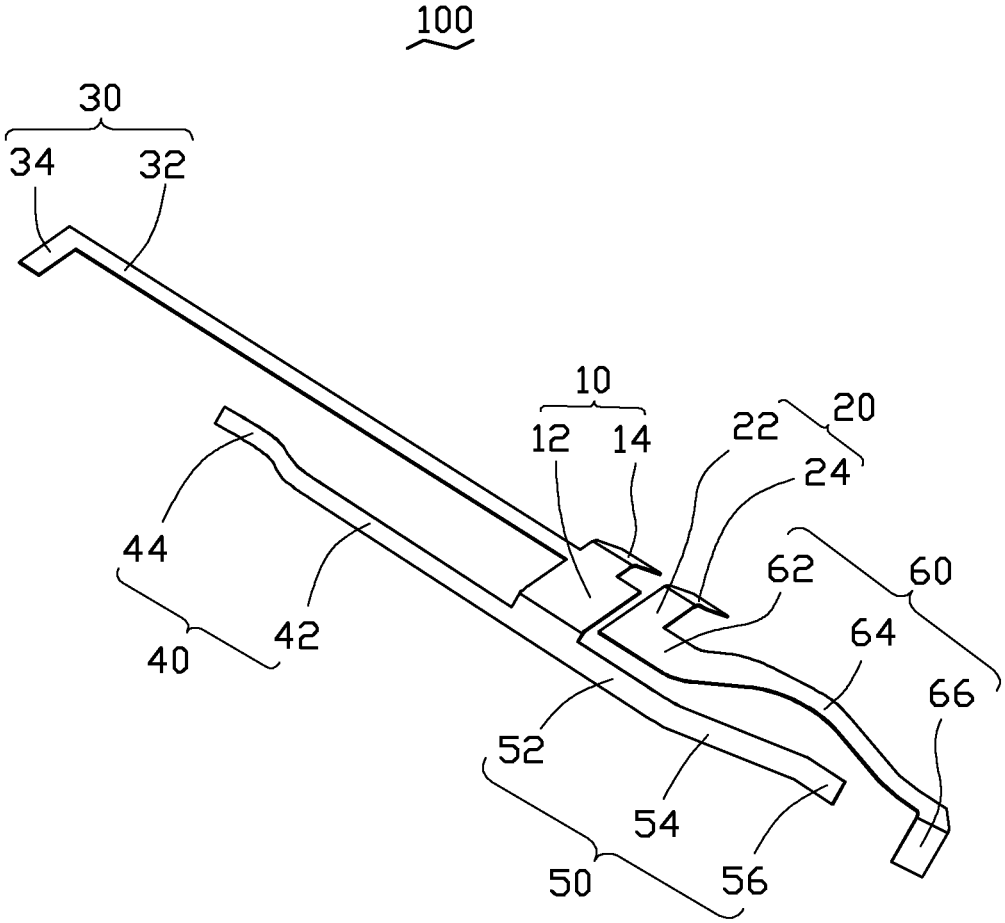
FIG. 1 is a schematic view of an antenna structure, according to an exemplary embodiment.

FIG. 1 shows an antenna structure 100, according to an exemplary embodiment. The antenna structure 100 is employed in a wireless communication device (not shown). The wireless communication device may be a mobile phone or a personal digital assistant, for example.

The antenna structure 100 includes a feed end 10, a grounding end 20, a first main radiator 30, a second main radiator 40, a third main radiator 50, and a first coupling radiator 60.

The feed end 10 includes a feed portion 12 and a connection portion 14. The feed portion 12 is a rectangular sheet. The connection portion 14 is connected to the feed portion 12 at an obtuse angle, and is configured to provide current to the antenna structure 100.

The grounding end 20 includes a coupling portion 22 and a grounding portion 24. The coupling portion 22 is a rectangular sheet positioned coplanar with the feed portion 12, and separates from the feed portion 12. Thus, a gap (not labeled) is defined between the feed portion 12 and the coupling portion 22. In the exemplary embodiment, a width of the gap is about 0.5 cm to about 0.8 cm to allow current on the feed portion 12 to be coupled to the coupling portion 22. The grounding portion 24 is connected to the coupling portion 22 at an obtuse angle, and the antenna structure 100 is grounded through the grounding portion 24.

The first main radiator 30 is positioned coplanar with the feed portion 12, and includes a first connecting section 32 and a second connecting section 34. The first connecting section 32 is a substantially planar sheet that is perpendicularly connected to a side of the feed portion 12. The second connecting section 34 is perpendicularly connected to a distal end of the first connecting section 32, and extends parallel to the feed portion 12.

The second main radiator 40 is positioned on a plane that is substantially perpendicular to a plane in which the feed portion 12 is positioned. The second main radiator 40 includes a first extending section 42 and a second extending section 44. The first extending section 42 is perpendicularly connected to an end of the feed portion 12 that is opposite to the connection portion 14. The second extending section 44 is a curved body connected to a distal end of the first extending section 42, and extends toward the first connecting section 32.

The third main radiator 50 is positioned on a plane that is substantially perpendicular to the plane in which the feed portion 12 is positioned, and is opposite to the second main radiator 40. The third main radiator 50 includes a first radiating section 52, a second radiating section 54, and a third radiating section 56. The first radiating section 52 is perpendicularly connected to the end of the feed portion 12 that is opposite to the connection portion 14, and is also connected to the first extending section 42. The second radiating section 54 is connected between the first radiating section 52 and the third radiating section 56 at a set angle. The third radiating section 56 is parallel to the first radiating section 52.

The first coupling radiator 60 includes an extending portion 62, an arc portion 64, and a bend portion 66. The extending portion 62 is perpendicularly connected to a side of the coupling portion 22. The arc portion 64 is connected to the extending portion 62, a first end of the arc portion 64 extends away from the first radiating section 52, and a second end of the arc portion 64 extends towards to the third radiating section 56. The bend portion 66 is perpendicularly connected to a distal end of the arc portion 64.

When current is input to the antenna structure 100 via the feed end 10, the first main radiator 30, the second main radiator 40, and the third main radiator 50 obtain the current from the feed end 10. Thus, the first main radiator 30 is activated for receiving and transmitting wireless signals having a first central frequency of about 824-960 MHz (such as GSM 850/EGSM 900/WCDMA V, VIII). In addition, the second main radiator 40 and the third main radiator 50 are activated for jointly receiving and transmitting wireless signals having a second central frequency of about 1710-1990 MHz (such as DCS/PCS/WCDMA II).

Figure 2:
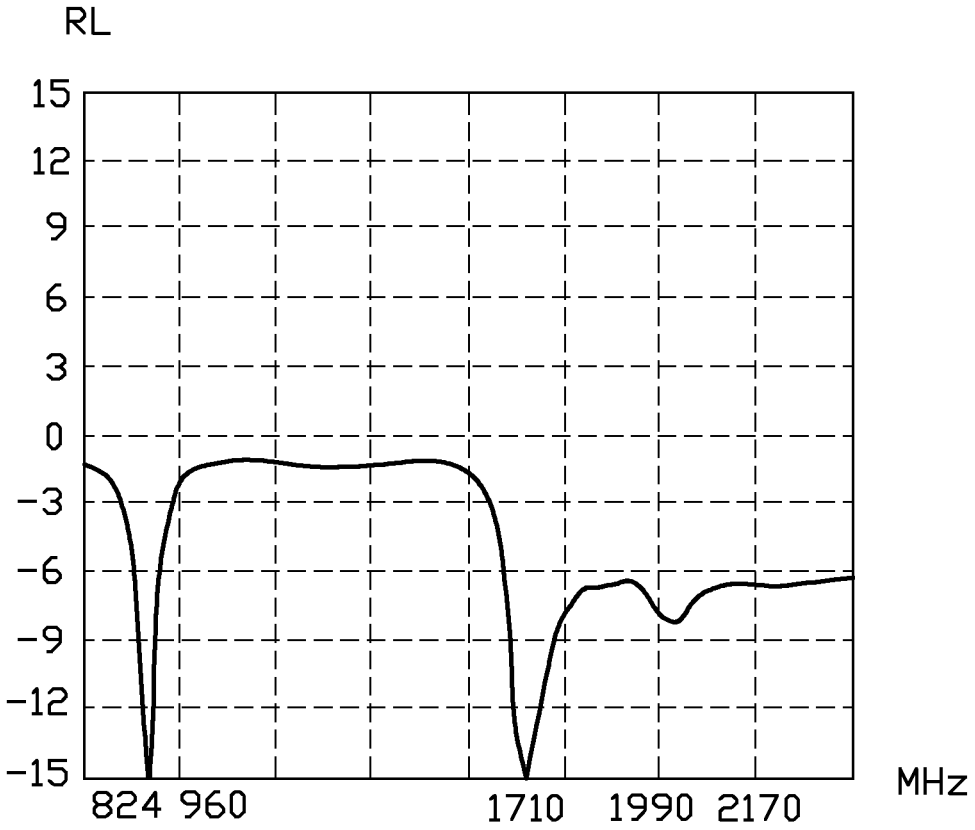
FIG. 2 is a return loss (RL) graph of the antenna structure shown in FIG. 1.

Additionally, the current is coupled from feed end 10 to the grounding end 20, and then the first coupling radiator 60 obtains the current from the grounding end 20. Moreover, the current is also coupled from the third main radiator 50 to the first coupling radiator 60. Thus, the first coupling radiator 60 is activated for receiving and transmitting wireless signals having a third central frequency of about 1990-2170 MHz (such as WCDMA I). FIG. 2 is a return loss (RL) graph of the antenna structure 100 of FIG. 1. The antenna structure 100 has good performance when operating at central frequencies of about 824-960 MHz, 1710-1990 MHz, and 1990-2170 MHz.

In other embodiments, one or two of the first main radiator 30 and the second main radiator 40 can be omitted.

In other embodiments, another coupling radiator can be connected to the coupling portion 22, and obtains current from the coupling portion 22 and the third main radiator 50.

In summary, the antenna structure 100 includes a feed end 10 and a grounding end 20 separated from each other. At least one main radiator is connected to the feed end 10, and at least one coupling radiator is connected to the grounding end 20. Thus, the current on the feed end 10 can be coupled to the grounding end 20, and the coupling radiator connected to the grounding end 20 obtains the current. Additionally, the current on the at least one main radiator connected to the feed end 10 can also be coupled to the least one coupling radiator. Therefore, the antenna structure 100 is small in size and has good communication quality at a plurality of frequency bands used in wireless communications, which allows further size reductions of the wireless communication device employing the antenna structure 100.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:

a feed end comprising a feed portion;

a grounding end separated from the feed end;

at least one main radiator connected to the feed end and comprising a first main radiator, wherein the first main radiator comprises a first connecting section and a second connecting section, the first connecting section is perpendicularly connected to a side of the feed portion, the second connecting section is perpendicularly connected to a distal end of the first connecting section, and extends parallel to the feed portion; and at least one coupling radiator connected to the grounding end;

wherein current on the feed end is coupled to the grounding end, and current on the least one main radiator is coupled to the at least one coupling radiator.

2. The antenna structure as claimed in claim 1, wherein the grounding end comprises a coupling portion, the coupling portion is positioned coplanar with the feed portion, and separates from the feed portion.

3. The antenna structure as claimed in claim 1, wherein the first main radiator is positioned coplanar with the feed portion.

4. The antenna structure as claimed in claim 1, wherein the at least one main radiator further comprises a second main radiator positioned on a plane that is perpendicular to a plane in which the feed portion is positioned.

5. The antenna structure as claimed in claim 4, wherein the second radiator comprises a first extending section and a second extending section, the first extending section is perpendicularly connected to an end of the feed portion, the second extending section is a curved body connected to a distal end of the first extending section.

6. The antenna structure as claimed in claim 5, wherein the at least one main radiator comprises a third main radiator positioned on a plane that is perpendicular to the plane in which the feed portion is positioned.

7. The antenna structure as claimed in claim 6, wherein the third main radiator comprises a first radiating section, a second radiating section, and a third radiating section, the first radiating section is perpendicularly connected to the end of the feed portion, and is connected to the first extending section, the second radiating section is connected between the first radiating section and the third radiating section, the third radiating section is parallel to the first radiating section.

8. The antenna structure as claimed in claim 7, wherein the at least one coupling radiator comprises a first coupling radiator, the first coupling radiator comprises an extending portion, an arc portion, and a bend portion, the extending portion is perpendicularly connected to a side of the coupling portion, the arc portion is connected to the extending portion, a first end of the arc portion extends away from the first radiating section, and a second end of the arc portion extends towards to the third radiating section, the bend portion is perpendicularly connected to a distal end of the arc portion.

9. The antenna structure as claimed in claim 7, wherein the current on the third main radiator is coupled to the first coupling radiator.

10. An antenna structure, comprising:

a feed end;

a grounding end separated from the feed end;

a first main radiator connected to a side of the feed end;

a second main radiator connected to an end of the feed end;

a third main radiator connected to the end of the feed end, and being opposite to the second main radiator; and a first coupling radiator connected to a side of the grounding end;

wherein current on the feed end is coupled to the grounding end, and current on the third main radiator is coupled to the first coupling radiator.

11. The antenna structure as claimed in claim 10, wherein the feed end comprises a feed portion, the grounding end comprises a coupling portion, the coupling portion is positioned coplanar with the feed portion, and separates from the feed portion.

12. The antenna structure as claimed in claim 11, wherein the first main radiator comprises a first connecting section and a second connecting section, the first connecting section is perpendicularly connected to a side of the feed portion, the second connecting section is perpendicularly connected to a distal end of the first connecting section, and extends parallel to the feed portion.

13. The antenna structure as claimed in claim 11, wherein the second radiator comprises a first extending section and a second extending section, the first extending section is perpendicularly connected to an end of the feed portion, the second extending section is a curved body connected to a distal end of the first extending section.

14. The antenna structure as claimed in claim 12, wherein the third main radiator comprises a first radiating section, a second radiating section, and a third radiating section, the first radiating section is perpendicularly connected to the end of the feed portion, and is connected to the first extending section, the second radiating section is connected between the first radiating section and the third radiating section, the third radiating section is parallel to the first radiating section.

15. The antenna structure as claimed in claim 14, wherein the first coupling radiator comprises an extending portion, an arc portion, and a bend portion, the extending portion is perpendicularly connected to a side of the coupling portion, the arc portion is connected to the extending portion, a first end of the arc portion extends away from the first radiating section, and a second end of the arc portion extends towards to the third radiating section, the bend portion is perpendicularly connected to a distal end of the arc portion.

* * * * *